United States Patent [19]

Kuzuya

[11] Patent Number: 4,502,802

[45] Date of Patent: Mar. 5, 1985

[54] PRINTING APPARATUS A CORRECTION RIBBON

[75] Inventor: Susumu Kuzuya, Nagoya, Japan

[73] Assignee: Brother Kogyo Kabushiki Kaisha, Nagoya, Japan

[21] Appl. No.: 501,412

[22] Filed: Jun. 6, 1983

[30] Foreign Application Priority Data

Jun. 25, 1982 [JP] Japan ..... 57-110230

[51] Int. Cl.[3] ..... B41J 33/40

[52] U.S. Cl. ..... 400/212; 400/216.1; 400/695

[58] Field of Search ..... 400/212, 216, 216.1, 400/695, 696, 697, 697.1

[56] References Cited

U.S. PATENT DOCUMENTS

| | | | |
|---|---|---|---|
| 3,170,035 | 2/1965 | Moebius | 400/216.1 X |
| 3,880,271 | 4/1975 | Hebron | 400/216.1 X |
| 4,395,148 | 7/1983 | Grüner et al. | 400/212 |

FOREIGN PATENT DOCUMENTS

| | | | |
|---|---|---|---|
| 2515899 | 10/1976 | Fed. Rep. of Germany | 400/212 |
| 2929743 | 2/1981 | Fed. Rep. of Germany | 400/697.1 |
| 27385 | 3/1981 | Japan | 400/212 |
| 2057976 | 4/1981 | United Kingdom | 400/697.1 |
| 537851 | 3/1977 | U.S.S.R. | 400/212 |

*Primary Examiner*—Paul T. Sewell
*Assistant Examiner*—John A. Weresh
*Attorney, Agent, or Firm*—Moonray Kojima

[57] ABSTRACT

In a printing apparatus with a correction ribbon, a ribbon placement mechanism comprising a holder swingably supported on a carriage adapted to move along a printing line and holding a printing ribbon and a correction ribbon; a first lever supported on the carriage so as to be swingable between a first position and a second position; a first electromagnet for shifting the first lever from the first position to the second positon; a second lever supported on one end of the first lever so as to be swingable between a working position and a resting position; a second electromagnet for shifting the second lever from the resting position to the working position; and a coupling means coupling one end of the second lever with the holder, wherein the printing ribbon is selected and placed at a print position through operation of the first electromagnet, while the correction ribbon is selected and placed at the print position through the swing motion of the holder when both the first and second electromagnets are actuated.

3 Claims, 4 Drawing Figures

PRINTING APPARATUS A CORRECTION RIBBON

BACKGROUND OF THE INVENTION

1. Field of Invention

This invention relates to a printing apparatus having a correction ribbon and more particularly to a ribbon lifting mechanism for use in such printing apparatus.

2. Description of Prior Art

A prior printing apparatus of the type described has been disclosed, for example, in Japanese Laid Open Application Ser. No. 55-135274, Publication No. 57-59796 opened for public inspection on Apr. 10, 1982. In this prior printing apparatus, a correction ribbon supporting frame and a printing ribbon supporting frame are supported so as to be turned about a single axis and a pair of electromagnets are provided for locating the correction ribbon and the printing ribbon at the printing position. A lifting cam is interposed between one of the electromagnets and the printing ribbon supporting frame so that the printing ribbon supporting frame is located at the printing position through action of the lifting cam when the associated electromagnet is excited. A control member, a swingable member and an engaging member are interposed between the lifting cam and the other electromagnet and a rotary member is interposed between the lifting cam and the correction ribbon support frame. When both of the electromagnets are excited, the correction ribbon is located at the printing position through action of the control member, swingable member, engaging member and lifting cam.

The above mentioned conventional printing apparatus, disadvantageously, contains a large number of parts and is complex in structure and construction. Hence, many problems are likely to occur during assembly, use and maintenance of the apparatus. Accordingly, unavoidable high consts of manufacture and maintenance result.

SUMMARY OF THE INVENTION

Accordingly, an object of the invention is to provide a ribbon lifting mechanism which is responsive to high speed printing operation and which can carry out ribbon lifting operation in a reliable manner.

Another object is to provide a ribbon lifting mechanism which is simple in structure and construction, and inexpensive to produce and maintain.

The foregoing and other objects are attained in this invention which encompasses a ribbon lifting mechanism usable in a printing apparatus, which mechanism comprises a carriage adapted to move along a printing line; a holder supported swingably on the carriage and holding a printing ribbon and a correction ribbon at normally existing rest positions or at a print position; a first lever supported on the carriage so as to be swingable between a first position and a second position; a first electromagnet for shifting the first lever, which is normally held at the first position, to the second position, and for holding the first lever at the second position; a second lever supported on one end of the first lever so as to be swingable between a resting position and a working position; a second electromagnet for shifting the second lever, which is normally held at the resting position, to the working position and for holding the second lever at the working position; and a coupling means for movably coupling one end of the second lever to the holder. To select and place the printing ribbon from the normally held rest position to the print position, the first electromagnet is actuated to shift the first lever to the second position, whereby the holder is caused to swing through the second lever, and move the printing ribbon from the rest position to the print position. To select and place the correction ribbon from the normally held rest position to the print position, the first electromagnet is actuated to shift the first lever to the second position and the second electromagnet is actuated to shift the second lever to the working position, whereby the holder is caused to move the correction ribbon from the rest position to the print position.

DETAILED DESCRIPTION OF THE PREFERRED EMBODIMENTS

Figure 1:
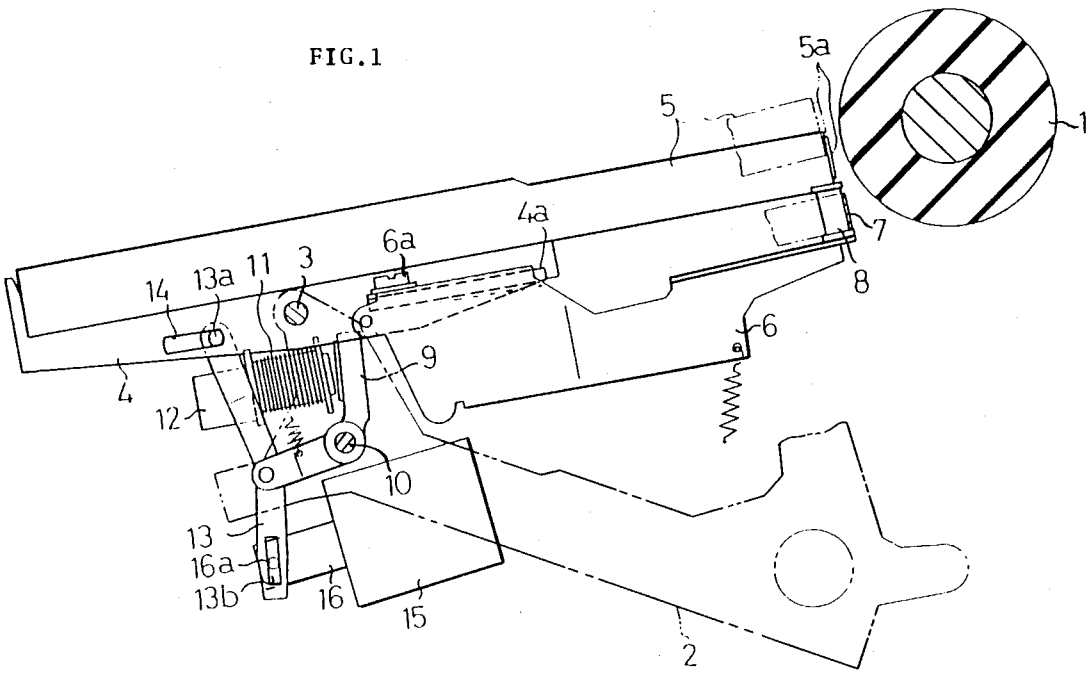
FIG. 1 is a side elevation view, partly in section, depicting an illustrative embodiment of the invention in one operative mode.

A preferred embodiment of the present invention will now be described with reference to FIGS. 1 through 4. A platen 1, for supporting a printing sheet, is supported rotatably, for example, on the rear part of a frame of a typewriter, which is not shown for convenience and simplicity of description. In front of the platen 1, a carriage 2 is supported on the frame so as to be movable longitudinally of platen 1, namely, along the printing line. A supporting shaft 3 is fixedly mounted on the upper part of the front part of carriage 2. A holder 4 is swingably supported at a central part thereof, by supporting shaft 3. A ribbon cassette 5, containing a printing ribbon 5*a*, is detachably mounted on the upper surface of holder 4. Part of printing ribbon 5*a* is exposed outside of ribbon cassette 5 and is disposed opposite to platen 1. Supporting lugs 4*a* project from both sides of holder 4, respectively. Frame members 6 are fixed at the respective base ends thereof with screw 6*a* to supporting lugs 4*a*. A take up spool for winding correction ribbon 7 and a supply spool for supplying correction ribbon 7, (neither of them being shown) are rotatably supported on frame members 6, respectively, near the respective ends of frame members 6. A guide roller 8, for guiding correction ribbon 7, is provided on the upper surface of the rear end of each frame member 6. Correction ribbon 7 is disposed below printing ribbon 5*a* and opposite to platen 1, all as depicted.

A shaft 10 is supported on carriage 2 below supporting shaft 3. A substantially L-shaped first lever 9 is supported swingably at a central part thereof on shaft 10 and is normally held at a first position, such as shown in FIG. 1. A first electromagnet 12 formed in a substantially U-shaped form and comprising a pair of cores 11 and coils wound on the cores, is fixed to carriage 2 so as to be disposed opposite to one end of first lever 9. When first electromagnet 12 is excited, first lever 9 (which has a part thereof near the core made of good magnetic material) is attracted to electromagnet 12 so that first lever 9 is turned in a counterclockwise direction (in FIG. 1), and first lever 9 is thereby positioned at a second position, such as shown in FIG. 2.

Figure 2:
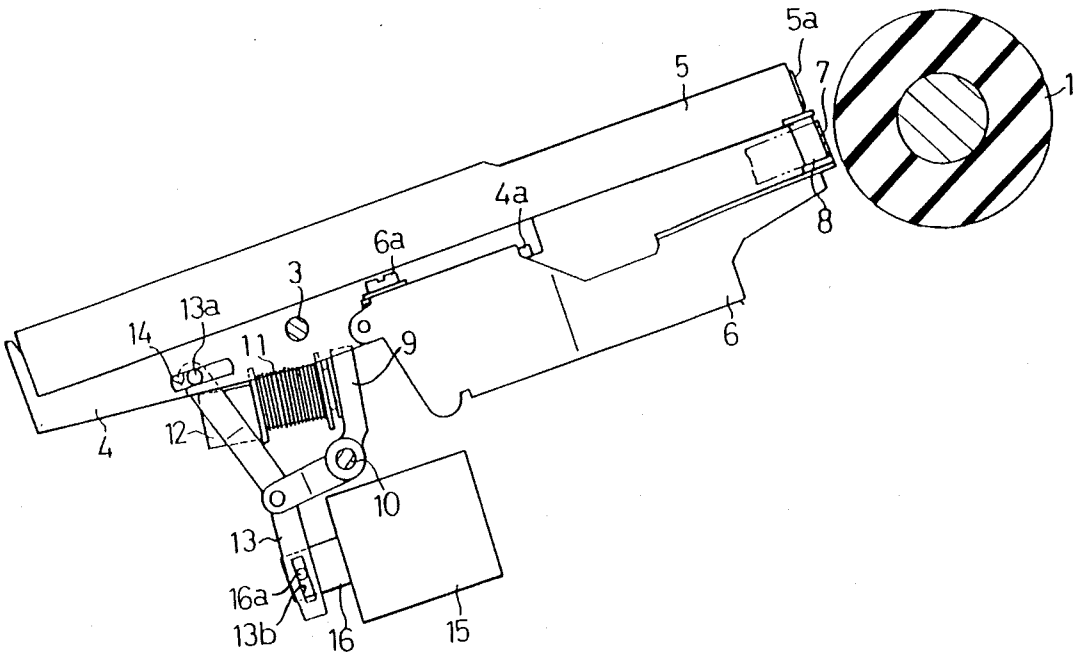
FIG. 2 depicts the embodiment of FIG. 1 in a different operative mode.
Figure 4:
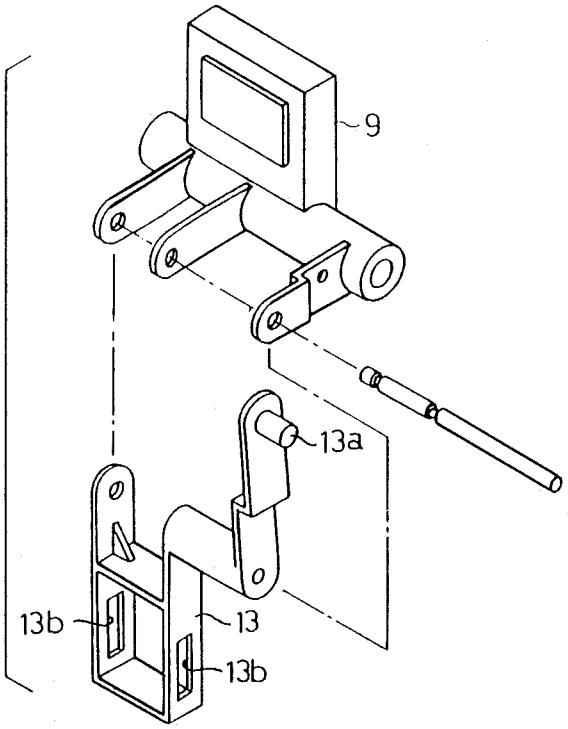
FIG. 4 is an exploded view, in perspective, depicting the first lever and second lever shown in FIG. 3
Figure 3:
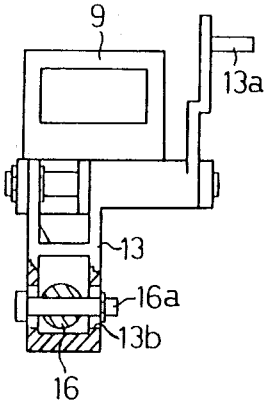
FIG. 3 is a front elevation view of the first lever and the second lever used in the embodiment of FIG. 1.

A second lever 13 is supported swingably on the other end of first lever 9, so as to be swingable between a resting position, such as shown in FIG. 1, and a working position, such as shown in FIG. 2. A coupling pin 13*a* protrudes from one end of second lever 12. A slot 13*b* is formed in the other end of second lever 13. A slot 14 having cam surface is formed in and disposed longitudinally of the side wall of holder 4 near the other end of second lever 13 in the manner depicted in FIGS. 1 and 2. Pin 13*a* is received in and movably positioned in slot 14. The combination of slot 14 and coupling pin 13*a* constitute a coupling mechanism for movably coupling second lever 13 and holder 4. A second electromagnet 15, e.g. of the plunger type, is supported near slot 13*b* of second lever 13, on carriage 2, as depicted in FIG. 1. A pin 16*a* is fixed to the extremity of a plunger 16 of second electromagnet 15 and is inserted into slot 13*b* of second lever 13 (see FIGS. 1, 2 and 3).

When second electromagnet 15 is excited, plunger 16 is moved from a projected position, such as shown in FIG. 1, to a retracted position, such as shown in FIG. 2. The second lever 13 is caused to turn in a counteclockwise direction in FIG. 1, through engagement of pin 16 and slot 13*b* as plunger 16 is retracted. Depressing a character key causes first electromagnet 12 to be excited, while depressing a character key successive to depressing the correction key causes the second electromagnet to be excited.

The control circuit to accomplish the foregoing are those usually found in electronic typewriters and the like, and are not herein shown for sake of convenience and simplicity of description of the invention.

The illustrative embodiment operates in the following manner. in FIG. 1, both first electromagnet 12 and second electromagnet 15 are not excited. Thus, first lever 9 is held at a first position, while second lever 13 is held at a resting position. In this nonoperative state, coupling pin 13*a* of second lever 13 and slot 14 are engaged in the manner depicted in FIG. 1 so as to locate printing ribbon 5*a* and correction ribbon 7, at the normally held resting positions.

Upon depressing of a character key, such as on a typewriter, only first electromagnet 12 is excited to attract one end of first lever 9, so that first lever 9 is turned on shaft 10 in a counterclockwise direction (in FIG. 1). The turning motion of first lever 9 causes second lever 13 to move downward, so that holder 4 is turned on supporting shaft 3 in a counterclockwise direction in FIG. 1, to lift printing ribbon 5*a*, to a first lift position, whereat printing ribbon 5*a* is located opposite the front surface of platen 1, that is from the resting position to the print position. A character corresponding to the depressed character key is printed on a printing sheet on platen 1, through the cooperative operation of print ribbon 5*a* and a printing head operated by depression of the character key.

In the event an erroneous character is typewritten, carriage 2 is first returned, by operating a backspace key, to a position corresponding to the erroneously printed character. Next, a correction key is depressed and then a character key corresponding to the erroneously printed character, is depressed, thereby causing excitation of first electromagnet 12 and second electromagnet 15. Consequently, first lever 9 is shifted to the second position, such as shown in FIG. 2, and plunger 16 is retracted to the retracted position, such as shown in FIG. 2. Thus, second lever 13 is turned in a counterclockwise direction through engagement between pin 16*a* and slot 13*b* to the operating position, such as shown in FIG. 2. The combined action of the turning of first lever 9 and that of second lever 13 through action of the coupling mechanism comprising coupling pin 13*a* and the cam surface of the slot 14, causes holder 4 to turn on supporting shaft 3 to a second lift position, that is print position, such as shown in FIG. 2, whereat correction ribbon 7, supported on frame members 6, is located opposite the front surface of platen 1. Then, the erroneously printed character is erased by correction ribbon 7, through operation of a printing head.

As described hereinbefore, according to the present invention, the printing ribbon or the correction ribbon, can be selectively and reliably lifted and placed at the print position through use of a mechanism which is simple in construction and structure and which can be inexpensively manufactured and maintained.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A printing apparatus using a printing ribbon and a correction ribbon, said apparatus comprising a platen;

a carriage which is movable along said platen;

a holder for supporting said printing ribbon and said correction ribbon in normally held respective rest positions and for moving said printing ribbon and said correction ribbon swingably to a print position, said holder being swingably mounted on said carriage;

a first lever having a first end, a second end and an intermediate part, said first lever being pivotally supported about a pivot point at said intermediate part on said carriage so as to be swingable between a normally held first position and a second position;

a first electromagnet disposed in attracting relation to said first end of said first lever for shifting said first lever from said first position to said second position by rotating said first lever about said pivot point, and for holding said first lever at said second position;

a second lever having a first end, a second end, and an intermediate part, said second lever being pivotally supported on said second end of said first lever so as to be swingable between a normally held resting position and a working position, and wherein said second end of said second lever has a closed slot therein;

a second electromagnet having a plunger and a pin holding means thereon, said second electromagnet being disposed to have said pin holding means connected rotatably to said closed slot of said second lever for shifting said second lever from said resting position to said working position and holding said second lever at said working position;

coupling means movably coupling said first end of said second lever to said holder, said coupling means comprising a first pin supported on said second lever, and said holder having formed therein a first slot having cam surface and being shaped to cooperate with said first pin; and said coupling means operating on said holder for holding said holder positioned at any desired position by movement of said second lever; wherein to select and move said printing ribbon from said rest position to said print position, said first electromagnet is actuated to said first lever from said first position to said second position so that said holder is caused to swing through said second lever, thereby to move said printing ribbon from its rest position to said print position whereat said coupling acting through said second lever on said holder holds said printing ribbon at said print position; and wherein to select and move said correction ribbon from said rest position to said print position, said first electromagnet is actuated to shift said first lever from said first position to said second position and said electromagnet is concurrently actuated to shift said second lever from said resting position to said working position, thereby to move said holder to swingably move said correction ribbon from its rest position to said print position whereat said coupling means acting through said second lever on said holder holds said correction ribbon at said print position.

2. The apparatus of claim 1, wherein said holder supports said printing ribbon above said correction ribbon in a position whereat said correction ribbon and said printing ribbon are disposed opposite to said platen.

3. The apparatus of claim 2, wherein said holder is caused to swing through said coupling means to lift said printing ribbon to said print position when said first electromagnet is actuated to move said first lever to said second position and said holder is caused to swing further through movement of said first pin along said first slot, to lift said correction ribbon to said print position, when said second electromagnet is actuated successively to actuation of said first electromagnet to cause said second lever to swing to said working position.

* * * * *